US005363680A

United States Patent [19]

Wu

[11] Patent Number: 5,363,680

[45] Date of Patent: Nov. 15, 1994

[54] STRUCTURE FOR KEY CHAIN

[76] Inventor: Yeou-Jyh Wu, No. 156-6, Sec. 3, Chung-kang Rd., Taichung, Taiwan, Prov. of China

[21] Appl. No.: 95,836

[22] Filed: Jul. 22, 1993

[51] Int. Cl.[5] ..... A47G 29/10

[52] U.S. Cl. ..... 70/456 R; 24/3 K; 24/656; 70/456 B; 70/459; 206/37.6; 206/37.7

[58] Field of Search ..... 70/456 R, 456 B, 457, 70/459, 460; 24/615, 653, 656, 3 K; 206/37.5, 37.6, 37.7

[56] References Cited

U.S. PATENT DOCUMENTS

| | | | |
|---|---|---|---|
| 3,014,744 | 12/1961 | Craik | 24/653 X |
| 3,867,823 | 2/1975 | Waltower | 70/456 B |
| 3,968,670 | 7/1976 | Quenot | 70/456 R |
| 4,282,733 | 8/1981 | Schmitt | 70/456 R |
| 4,420,860 | 12/1983 | Chamuel | 24/615 X |
| 4,713,951 | 12/1987 | Ros | 70/456 R |

FOREIGN PATENT DOCUMENTS

| | | | |
|---|---|---|---|
| 0641902 | 8/1928 | France | 24/656 |

*Primary Examiner*—Lloyd A. Gall
*Attorney, Agent, or Firm*—Bacon & Thomas

[57] ABSTRACT

The present invention relates to an improved structure for key chain, comprising a main body having a thread at the upper end to enable it to be screwed onto the bottom end of a fixed seat, and the main body further having a chamber therein for receiving a disk spring and a top ring that is inserted onto the main body, and the disk spring is held with a conical body on the bottom of the top ring, and a key fastener held by the disk spring is then inserted. When the key fastener is intended for removal, pushing up the top ring will cause the conical body on the bottom of the top ring to prop open the sheet cones of the disk spring, and the key fastener can be removed.

1 Claim, 4 Drawing Sheets

STRUCTURE FOR KEY CHAIN

FIELD OF THE INVENTION

This invention relates to an improved structure for key chain, and particularly to a key chain that is easy and quick to assemble, but not vulnerable to fall off.

SUMMARY OF THE INVENTION

Generally speaking most of conventional type key chains are complicated in the assembly of parts and further it is troublesome for dismantling and assembling a key chain that is too vulnerable to fall off.

One object of the present invention is to provide an improved structure for a key chain, comprising a main body that incorporates a disk spring. When key fastener is intended for separating from the main body, push up the top ring by means of a conical body pushing the disk spring away will result in separating the key fastener from the main body.

BRIEF DESCRIPTION OF THE INVENTION

DETAILED DESCRIPTION OF PREFERRED EMBODIMENT

Figure 1:
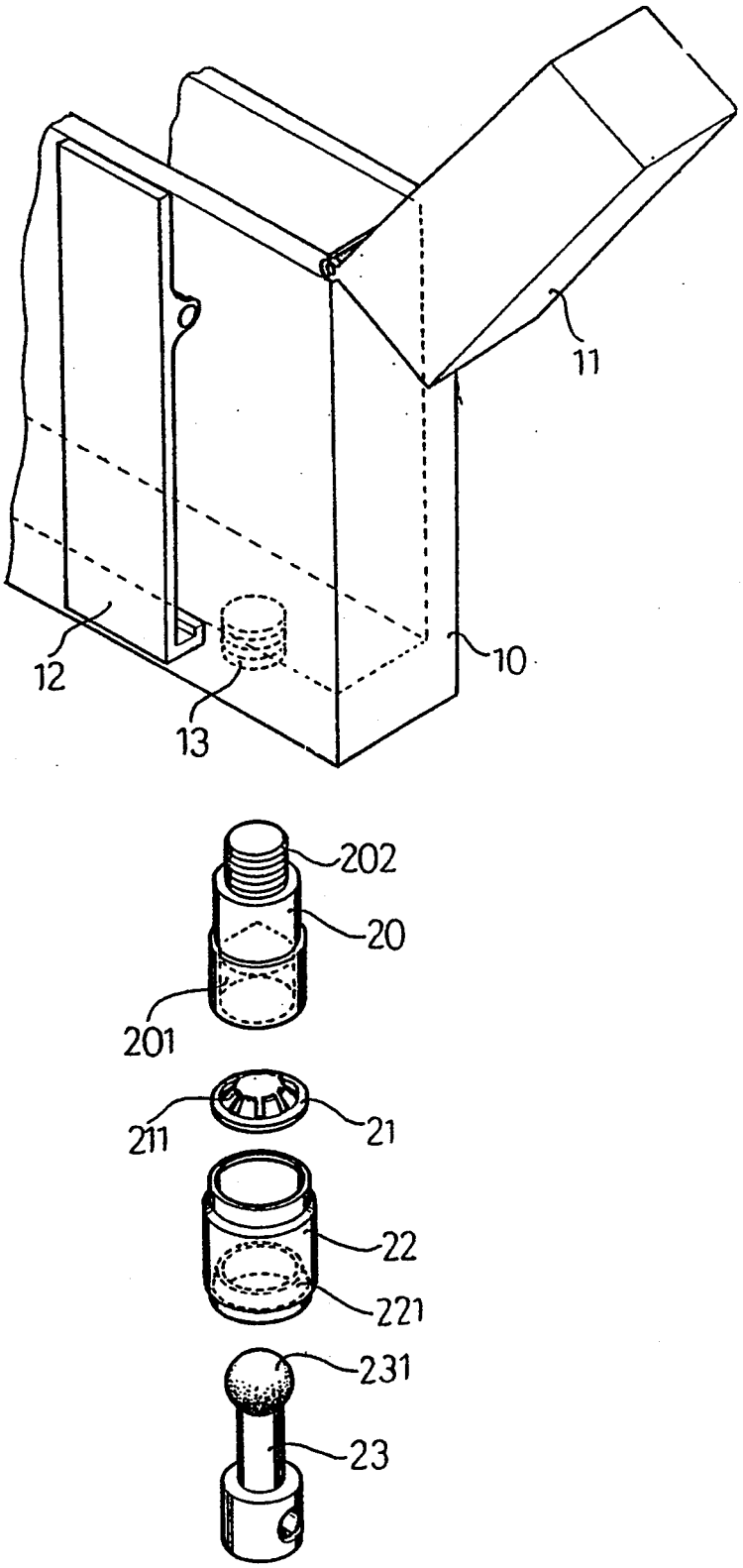
FIG. 1 is an exploded perspective view of the improved structure for a key chain according to the present invention.

Referring to FIG. 1, the improved structure for key chain of the present invention comprises, a fixed seat 10, main body 20, disk spring 21, top ring 22 and key fastener 23.

The fixed seat 10 resembles a rectangular body having a movable cover 11 and a chamber for loading daily portable articles, and externally having a clasp 12 for fastening it onto a belt to make it portable. Also on the bottom of fixed seat 10 are a plurality of threaded holes 13 for screwing up with a plurality of main bodies 20.

The main body 20 resembles a circular body and on its top has thread 202 that enables it to be screwed into the fixed seat 10, and has a chamber 201 therein for receiving the disk spring 21 and key fastener 23 therein.

The disk spring 21 has a top consisted of a plurality of conical spring arms 211.

The top ring 22 resembles a circular hollow body and on the bottom has a conical body 221.

The key fastener 23 has a round ball 231 at the upper end.

Figure 2:
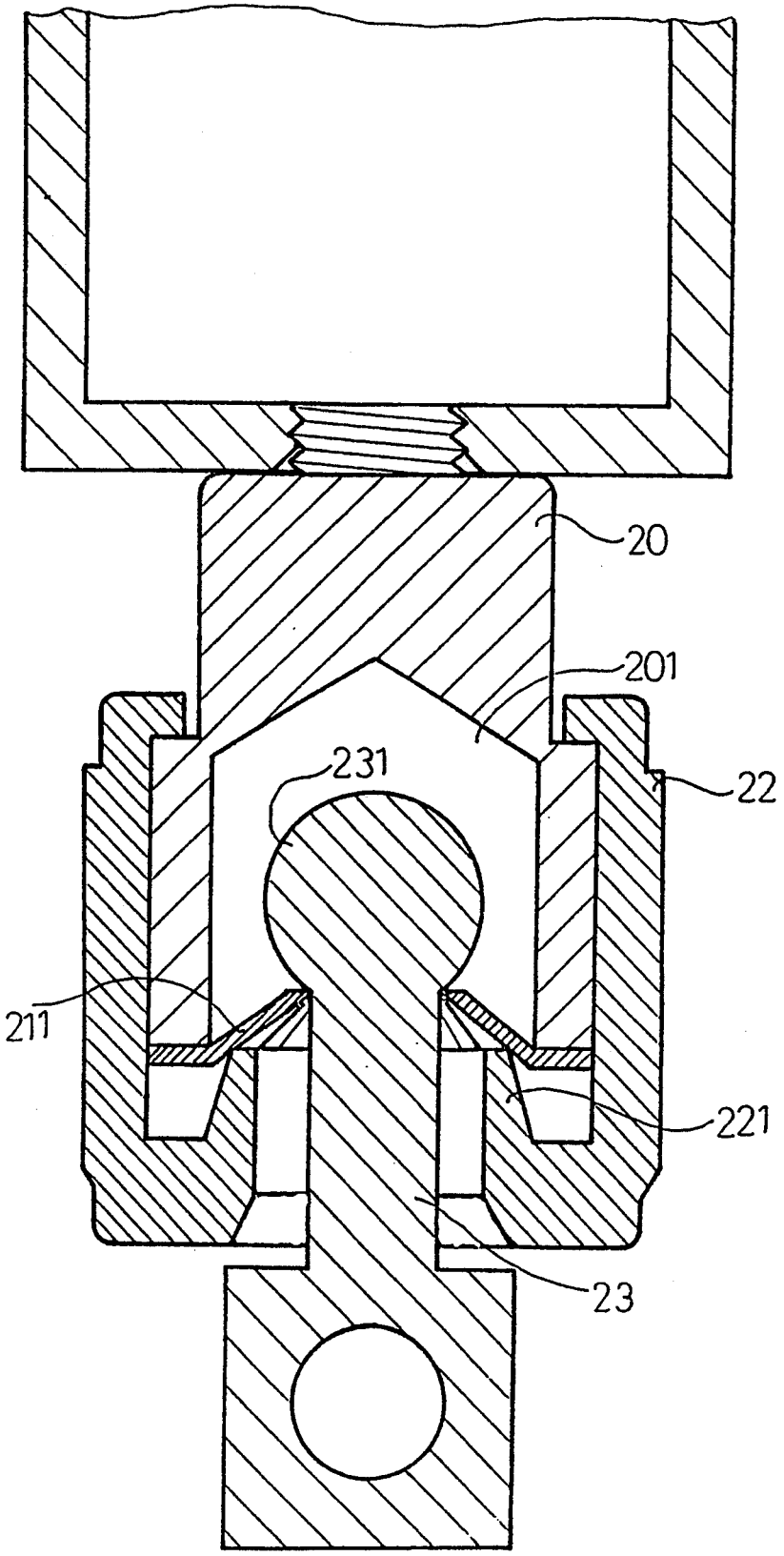
FIG. 2 is a cross-sectional view of the improved structure for key chain of FIG. 1.

Referring to FIG. 2, for assembly, at first insert the disk spring 21 in the chamber 201 of the main body 20, then place the top ring 22 onto the main body 20, and let the upper end of top ring 22 be inwardly deformed whereby the top ring 22 can be fitted on the main body 20 without risk of falling off. The spring arms 211 of disk spring 21 are opened with the round ball 231 of key fastener 23 to hold the ball 231 within the chamber 201 of main body 20. Because the round ball 231 is held with resilience of the spring arms 211, the key fastener 23 is hence prevented from falling off.

Figure 3:
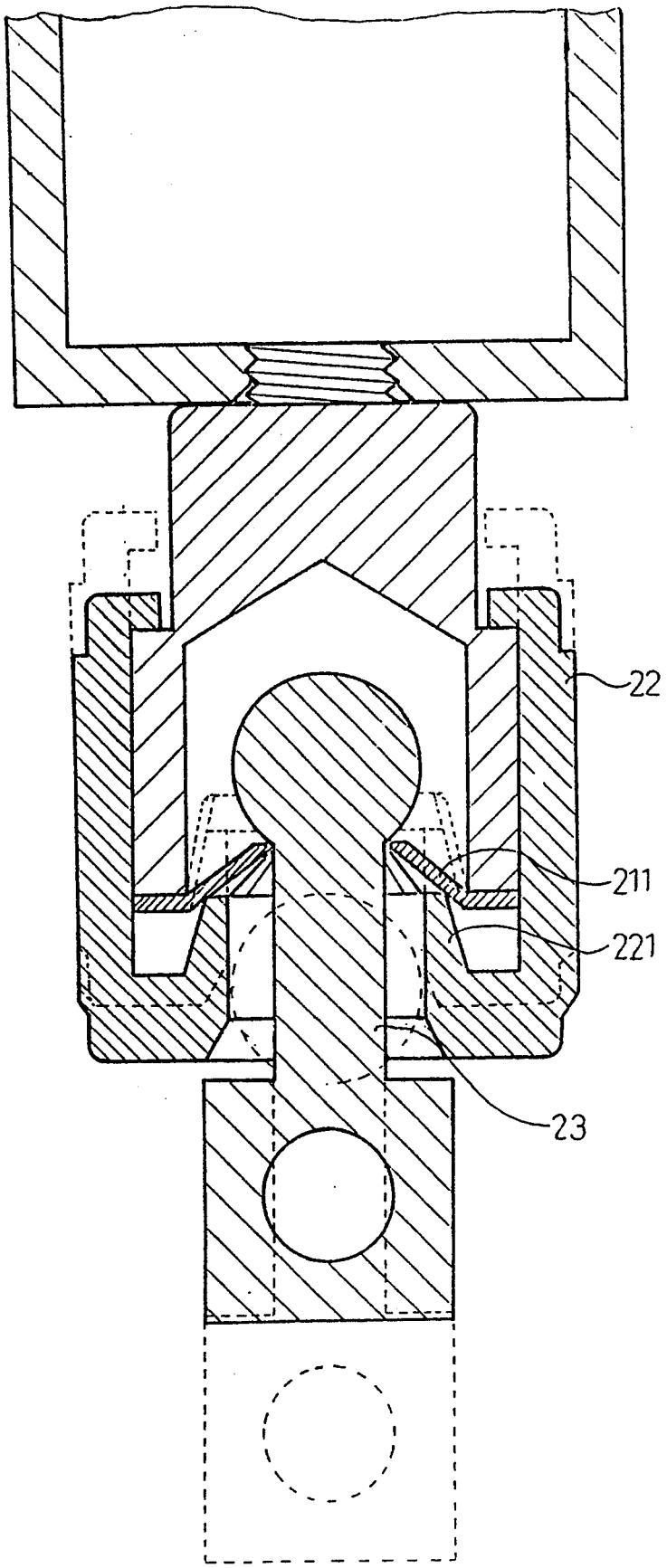
FIG. 3 is a cross-sectional view of the improved structure for key chain in operation.
Figure 4:
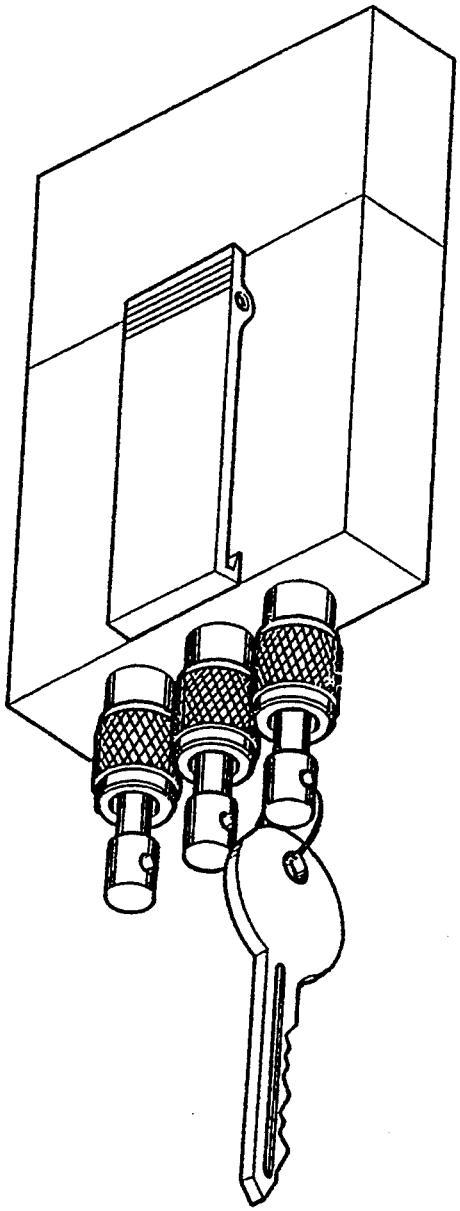
FIG. 4 is a perspective view of the improved structure for key chain.

Referring to FIG. 3, when the key fastener 23 is intended for removal so as to use the key, pushing up the top ring 22 will prop open the spring arms 211 by means of conical portion 221 of top ring 22, whereby the key fastener 23 can be removed for use while spring arms 211 will push the top ring 22 back to permit prompt insertion of key fastener 23 again so as to attain the purpose of quick and easy removal/assembly of the key fastener 23.

What is claimed is:

1. An improved structure for a key chain, comprising:

a) a fixed seat having a movable cover and a chamber, and externally having a clasp, and defining a plurality of threaded holes;

b) a main body having a threaded top portion to be screwed into one of the threaded holes of the fixed seat, and defining a chamber therein;

c) a disk spring located in the chamber and having a plurality of conical spring arms defining an opening;

d) a top ring having a circular hollow body configured to movably receive a portion of the main body and a bottom portion having a conical body located so as to contact the spring arms; and e) a key fastener having a ball at an upper end, the ball having a cross-sectional dimension greater than that of the opening defined by the spring arms whereby, said disk spring is inserted within said chamber of said main body, and said ball of said key fastener is held by the spring arms of said disk spring to hold said key fastener without risk of falling off and when said key fastener is to be removed said top ring is moved relative to said main body to cause said conical body on said top ring to prop open said spring arms of said disk spring so that said key fastener is thus removed.

* * * * *